United States Patent [19]

Ogawa

[11] 4,057,929

[45] Nov. 15, 1977

[54] MOBILE RECONFIGURABLE SPHERICAL TOY

[75] Inventor: Iwakichi Ogawa, Kashiwa, Japan

[73] Assignee: Takara Co., Ltd., Japan

[21] Appl. No.: 694,250

[22] Filed: June 9, 1976

[51] Int. Cl.[2] ..... A63H 17/00

[52] U.S. Cl. ..... 46/201; 46/249

[58] Field of Search ..... 46/201, 248, 249, 269

[56] References Cited

U.S. PATENT DOCUMENTS

| | | | |
|---|---|---|---|
| 2,949,697 | 8/1960 | Licitis et al. | 46/269 |
| 3,733,739 | 5/1973 | Terzian | 46/248 |

*Primary Examiner*—Louis G. Mancene
*Assistant Examiner*—Robert F. Cutting
*Attorney, Agent, or Firm*—Harold L. Jackson; Stanley R. Jones; Joseph W. Price

[57] ABSTRACT

A substantially spherical or ball-shaped toy is provided and includes a number of press- and snap-fitted spherical sections which may be removed from a base member and attached at various positions on the base member to form various other toy configurations. The base additionally encloses an electric motor and driving assembly to provide motion in the various configurations.

19 Claims, 4 Drawing Figures

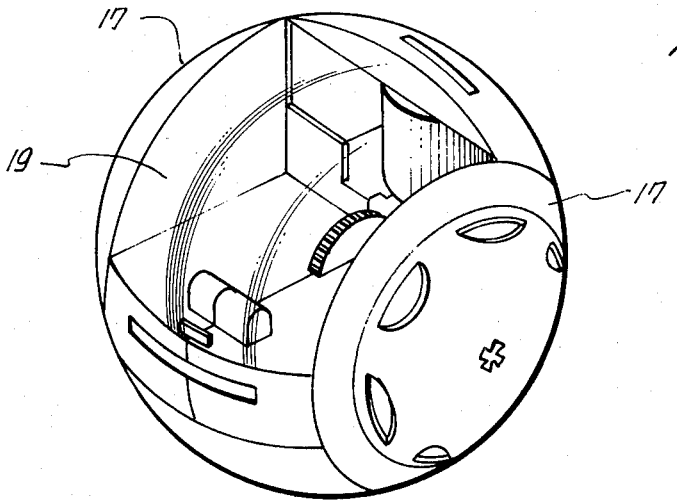
FIG. 1
FIG. 2
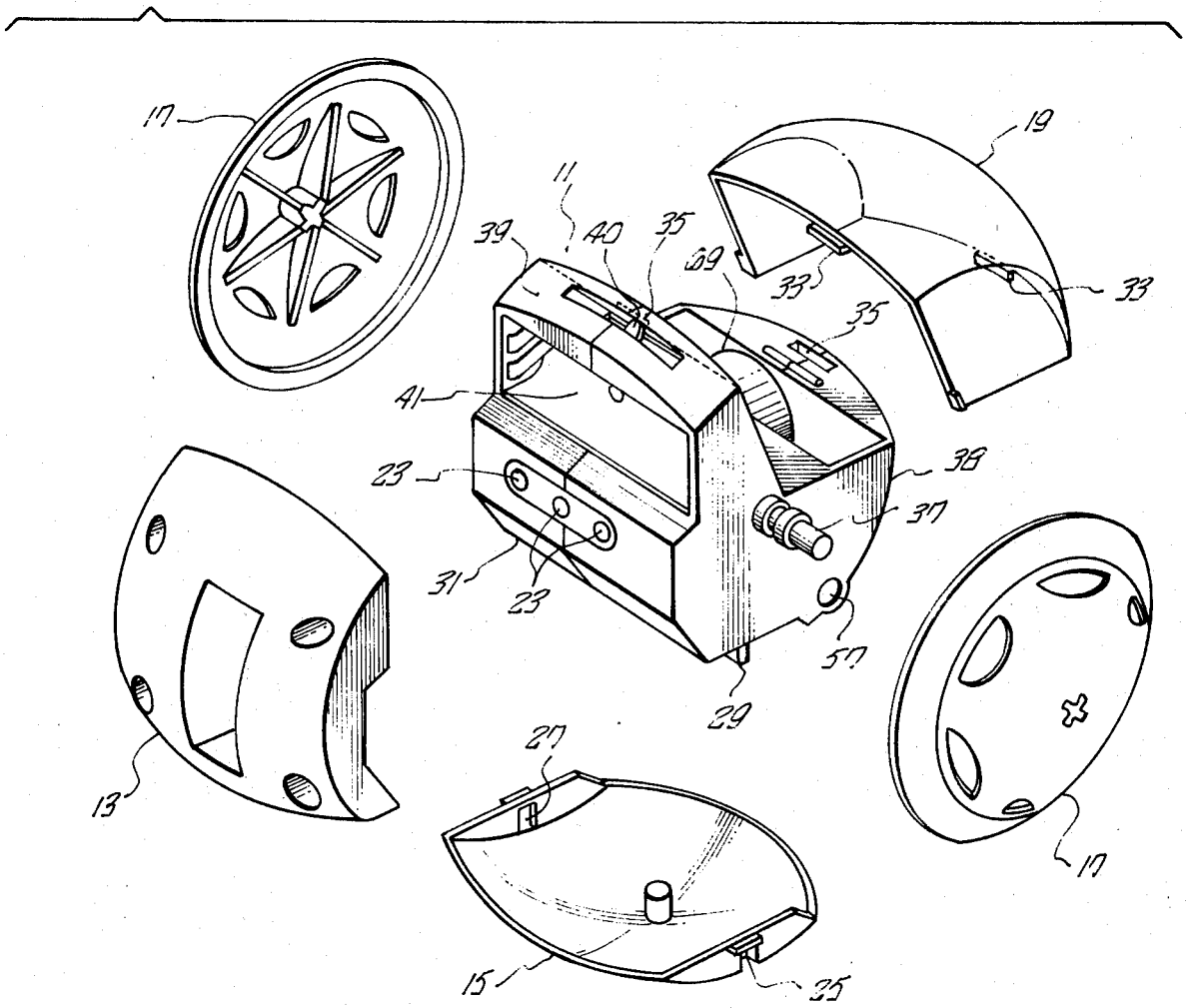

MOBILE RECONFIGURABLE SPHERICAL TOY

BACKGROUND OF THE INVENTION

1. Field of the Invention

The subject invention relates to toys and more particularly to a toy which may be easily assembled and disassembled to form a variety of configurations. In particular, the possible geometric shapes and configurations provided according to the invention are such that envisioning them challenges and heightens the sense of perspective and perception of abstract space.

2. Brief Description of the Prior Art

Prior art has provided various forms of spherically shaped toys that are self-energized and mobile. The general purpose of these toys has been to stimulate interest in the toy by virtue of its capacity for locomotion. That is, the mere fact that a ball is so driven has been one of the main objects in the novel feature of the toys.

An illustrative example of this form of toy can be seen in U.S. Pat. Nos. 2,939,246 and 3,722,134.

The known prior art to date has not provided a unique spherical toy combination that is compatible with the concept of a simulated operator-controlled vehicle which can be further broken into subcomponents for assembly into other toy configurations, either alone or with additional accessory parts.

SUMMARY OF THE INVENTION

These and other objects of the invention are accomplished by providing a base member with a number of connections to which substantially spherical sections may be snap-fitted to form a toy which initially appears substantially spherical. The spherical sections may then be detached and re-attached at other locations to provide a number of interesting toy configurations. An electric motor within the base member may be used to animate the various toy configurations.

The features of the present invention which are believed to be novel are set forth with particularity in the appended claims. The present invention, both as to its organization and manner of operation, together with further objects and advantages thereof, may best be understood by reference to the following description, taken in conjunction with the accompanying drawings.

BRIEF DESCRIPTION OF THE DRAWINGS

FIG. 1 is a perspective view of the preferred embodiment of the invention configured as a sphere.

FIG. 2 is an exploded view of the preferred embodiment of the invention illustrating the base member and associated spherical sections.

DETAILED DESCRIPTION OF THE PREFERRED EMBODIMENT OF THE INVENTION

Figure 3:
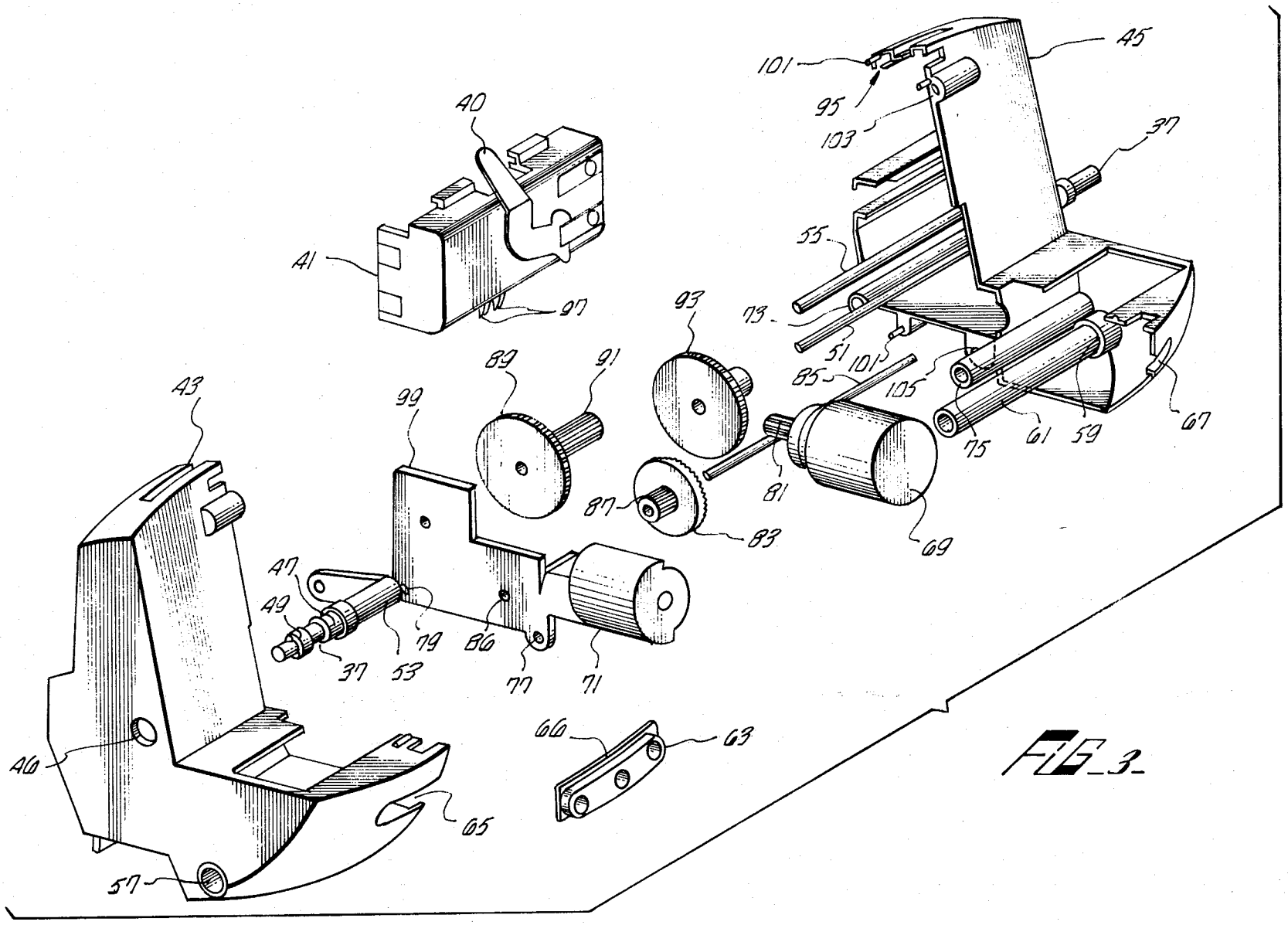
FIG. 3 is an exploded view of the base member of the preferred embodiment of the invention.

The following description is provided to enable any person skilled in the toy industry to make and use the invention and it sets forth the best modes contemplated by the inventor of carrying out this invention. Various modifications, however, will remain readily apparent to those skilled in the above art, since the generic principals of the present invention are applied herein specifically to provide a relatively economical and easily manufactured mobile reconfigurable spherical toy.

As illustrated in FIG. 2, the preferred embodiment of the invention includes a base or cabin member 11 to which various spherical sections 13, 15, 17, and 19 are snap-fitted or press-fitted by various means such that they may be easily removed and re-attached. The rear cover section 13 is attached to the base or cabin member 11 by means of a plug 21 (FIG. 4) which fits into the center one of three apertures 23 in the rear of the cabin 11. The lower section 15 includes two slots 25, 27 which are spaced so as to snap fit onto two respective nubs attached to the member 11. One of these nubs 29 is shown and the other is identical thereto and located generally at 31 on the opposite underside of the cabin 11. The canopy section 19 includes two tabs 33 which may be snap-fitted into respective apertures 35 by a slight flexure of the canopy member 19. Finally, two dish members 17 are attached to respective drive shaft hubs 37 on either side of the cabin base 11. In the preferred embodiment, the canopy member 19 and the lower section member 15 are preferably clear plastic.

This transparent canopy member 19 enhances the concept of an operator controlled feature. The toy is proportioned to receive a small doll figure (not shown) that can be mounted within the cabin. The doll figure can be utilized as a central character or operator figure in a number of different separate toys and subassembled toys from the component parts of the present toy.

The surfaces 38, 39 of the base member 11 are substantally spherically contoured such that when the spherical sections 13, 15, 17, and 19 are fitted to the base member 11 a substantially ball-shaped object results. The drive hubs 37 of the base member 11 may be rotated by actuation of a switch 40 by means to be described below in conjunction with the discussion of FIG. 2. The drive hubs are so placed on the cabin 11 and the lower section 15 is so dimensioned that when the section 15 is removed, the dish members 17 may be rotated by the hubs 37 so as to drive the toy across a surface. The means for actuating the drive hub 37 may be powered by batteries placed in a battery storage compartment 41.

The cabin base 11 is shown in more detail in FIG. 3. The base 11 includes two seat-shaped members 43, 45, having a number of apertures for performing various functions and adapted to receive one or more doll operators. The cab interior contains means for locomoting the toy including electric drive means and a rotatable cylinder 61. One feature of the cabin structure is the retaining of the elements of the electric drive means and the cylinder 61 or rotating idler power shaft in proper position by merely joining the cabin halves together.

Among the apertures in the cabin members 43, 45 are front apertures 65, 67 which retain an insert 63 containing press-fit apertures. The insert 63 has an edge 66 which is contoured to slide-fit into the seats provided by the front apertures 65, 67. The insert 63 provides additional flexibility in assembling the toy in various configurations.

To actuate the drive hubs 37, the cabin 11 includes an electric motor 69 mounted by means of a motor mounting bracket 71. This mounting bracket 71 is attached to the seat member 45 by means of screws applied through mounting bracket apertures 79, 77 to respective mounting posts 73, 75 molded as part of the seat member 45.

The motor 69 rotates the drive hubs 37 via a gear train including a number of parallel shafts and associated gears. A first gear 81 is attached to the drive shaft of the motor 69. The first gear 81 in turn drives a second gear 83 mounted on a first shaft 85 which rotates in an aperture 86 in the motor mount 71 and an aperture molded into the seat member 45. The first shaft 85 bears a third or pinion gear 87, smaller than the second gear 83, which drives a larger fourth gear 89 mounted on a second shaft 55. The second shaft 55 bears a fifth gear 91 smaller than the fourth gear 89, which drives the drive gear 93 attached to the drive shaft 51 on which are mounted the two drive hubs 37. Thus, a drive means is provided which is compact and simply assembled.

The power for the motor 69 is supplied by batteries stored in the battery storage container 41, which slide fits onto the molded edge 95 of the seat member 45 and is secured in lateral position by a U-shaped projection 97, which clamps onto an edge 99 of the motor mount 71 when the seat members 45, 43 are joined together.

To retain the battery case 41, the idler shaft or cylinder 61, press-fit apertures 63, the motor mount 71 and associated drive apparatus; the seat members 43, 45 are guided together by means of pins 101, which insert into complimentary apertures in the opposite seat member. The seat members may then be securely fastened by screws fixed at points 103, 105, thereby completing the simple assembly of the toy cabin member.

Figure 4:
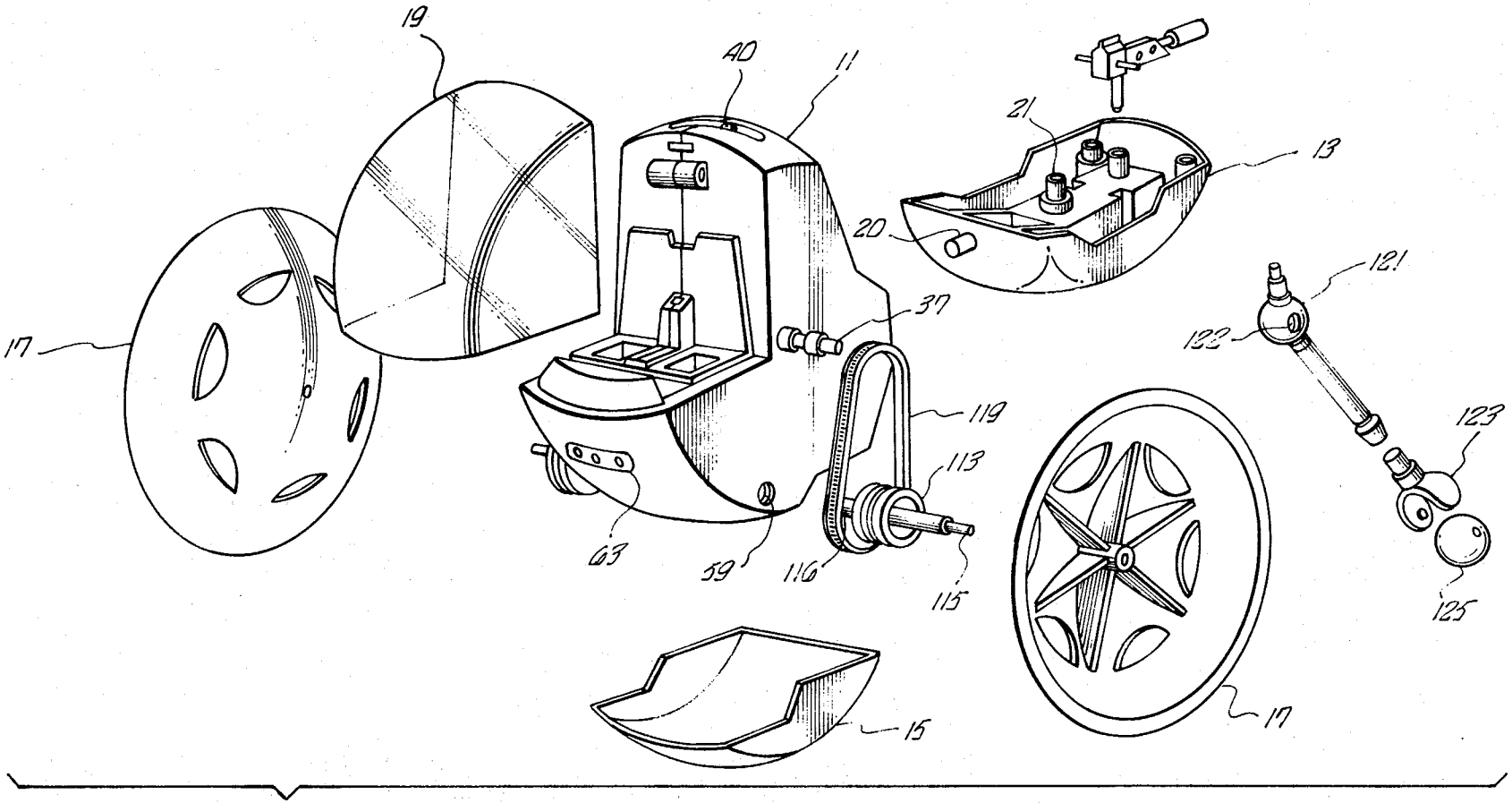
FIG. 4 is an exploded view illustrating a reconfiguration of the preferred embodiment of the invention.

FIG. 4 illustrates a configuration of the preferred embodiment of the invention. As there shown, additional elements including a pulley member 113 having plug tips 115, 116 and a flexible drive belt 119 may be utilized to provide a wheel driven vehicle. In this mode, the dish 17 is reversed and its press-fit aperture 117 is fitted onto the tip 115 of the pulley 113. The second tip 116 of the pulley member 113 is inserted through the aperture 59 of the base cabin 11 into the cylindrical roller 61 described in connection with FIG. 3 above. In addition, a plug 20 on the rear cover section 13 may be inserted into one of the press-fit apertures 23 (FIG. 1) to provide a tail turret. A leg member 121 pivotable at a point 122 may additionally be press-fitted into an aperture on the spherical side of the rear cover 13 in order to provide a support. Alternatively, the leg member 121 may be connected to a press-fit, U-shaped member 123 holding a snap-fitted roller 125 to provide a rolling support for the tail turret.

The elements of FIG. 4 may also be assembled to provide a rotating antenna configuration. In this configuration, one of the dishes 17 is placed on a flat surface such as a table to act as a base member. The cabin 11 is then placed on its side with the drive shaft plug 37 fitted directly into the aperture 117 of the dish base. A pulley member 113 mounted in the idler shaft or cylinder shaft 61 on the now top side of the base member 11 is used to drive a second dish 17 representing the radar antenna, snapped onto a leg member 121 attached to the pulley member 113.

Thus, it may be seen that the preferred embodiment of the invention provides the possibility of a great number of structural permutations and an accompanying creative challenge. Except for the electrical components, shafts, and motor; the preferred embodiment of the invention is entirely constructed of plastic components. However, other materials could be used. Since many other modifications may be made to the disclosed embodiment without departing from the scope of the invention, it is to be understood that, within the scope of appended claims, the invention may be practiced other than as specifically described above.

What is claimed is:

1. A toy assembly comprising;

a base member having a first and second side wall;

a drive train extending between said first and second sides and having output shaft ends extending respectively from each side wall;

a rotatable auxiliary shaft mounted within said base member for providing first and second rotatable coupling ends extending respectively from each side wall, and a plurality of section members, each having means for attachment to said base member, and contoured such that when said section members are connected to said base member, a substantially spherical toy object results.

2. The toy of claim 1 wherein said base member has at least one spherically contoured surface co-acting with said plurality of section members to form a substantially spherical object.

3. The toy of claim 1 wherein said base member contains a plurality of substantially identical base member apertures and wherein at least one of said means for attachment to said base member comprises a plug adapted to interchangeably fit into said base member apertures.

4. The toy of claim 3 further including at least one extension member means for connecting between one of said base member apertures and a said plug.

5. The toy of claim 4 wherein at least one of said sections has at least one section aperture substantially identical to said base member apertures.

6. The toy of claim 5 wherein said base member further includes driving means and means for interchangeably connecting said driving means to one of said sections.

7. The toy of claim 5 wherein said base member further includes driving means including a drive shaft having a drive shaft plug thereon and wherein at least one of said means for attachment to said base member comprises an aperture for accommodating said drive shaft plug.

8. The toy of claim 1 wherein a pair of section members have dish-shaped configurations and are respectively removably mounted to said output shaft ends.

9. The toy assembly of claim 1 further including a pulley assembly for mounting on a coupling end of said auxiliary shaft and an output shaft end of said drive train.

10. The toy assembly of claim 9 wherein at least one of said section members is operatively connected to one of said output shaft ends and said coupling ends, and means for driving said drive train.

11. The toy assembly of claim 1 wherein the rotatable coupling ends are press-fit connection points.

12. The toy assembly of claim 8 wherein the dish-shaped section members having mounting means on both their concave and convex sides.

13. A toy assembly capable of forming an approximately spherical toy object comprising;

a central base member having at least one exterior surface when positioned as part of a spherical toy object configuration;

drive means mounted in the base member;

a pair of side concave-convex members rotatably attached to either side of the base member for rotational driving relative to the base member by the drive means, the annular peripheral edges of the side members having a circular configuration which respectively support and drive the central base member and having further central mounting means on both the concave and convex sides and, an appended member connected to the exterior surface of the central base member and extending outward to provide a third support for the central base member, the central base member and side members are contoured such that when the side members are mounted on their concave side to the central base member they form an approximately spherical toy object.

14. The toy assembly of claim 13 wherein the central base member further includes a transparent canopy member.

15. The toy assembly of claim 13 wherein the drive means includes a pair of output shafts on either side of the base member and means for interconnecting each side set of output shafts.

16. The toy assembly of claim 15 wherein one output shaft is an idler shaft.

17. The toy assembly of claim 15 wherein a pulley assembly is mounted on at least one side set of output shafts.

18. A toy assembly capable of forming a substantially spherical toy comprising;

a base component member;

drive means positioned in the base component member;

a bottom component member having at least one sphery surface removably attached to the base component member;

a pair of sphery side component members removably attached to a respective side of the base component member and mounted adjacent opposite sides of the bottom component member, the side component members are adapted for power rotation by the drive means relative to the base member, each side component member being dimensioned such that its periphery edge has a circular configuration and a respective edge portion of each side component member extends below and supports the base component member when the bottom component member is removed from the base component member, the component members, when removably attached together, are capable of providing a substantially spherical contoured toy assembly with the radius of curvature of the bottom component sphery surface and sphery side component members being approximately equal.

19. The toy assembly of claim 18 further including mounting means on both sides of the sphery side components so that either side can be operatively connected to the base component member.

* * * * *